US005974639A

United States Patent [19]

Keller

[11] Patent Number: 5,974,639

[45] Date of Patent: Nov. 2, 1999

[54] NON-FLEX LOCKING BUCKLE

[75] Inventor: Steven C. Keller, Island Lake, Ill.

[73] Assignee: Illinois Tool Works Inc., Glenview, Ill.

[21] Appl. No.: 09/174,523

[22] Filed: Oct. 16, 1998

[51] Int. Cl.[6] ..... A44B 11/00

[52] U.S. Cl. ..... 24/662; 24/664; 24/625

[58] Field of Search ..... 24/662, 663, 664, 24/647, 666, 701, 324, 116 A, 683

[56] References Cited

U.S. PATENT DOCUMENTS

| | | | |
|---|---|---|---|
| 3,251,110 | 5/1966 | Hedu | 24/625 |
| 4,150,464 | 4/1979 | Tracy . | |
| 4,398,324 | 8/1983 | Bakker et al. . | |
| 4,402,445 | 9/1983 | Green . | |
| 4,811,469 | 3/1989 | Rise . | |
| 4,831,694 | 5/1989 | Kong . | |
| 4,987,661 | 1/1991 | Kasai . | |
| 4,998,329 | 3/1991 | Boros . | |
| 5,263,234 | 11/1993 | Fudaki | 24/662 |
| 5,291,641 | 3/1994 | Morino | 24/664 |
| 5,465,472 | 11/1995 | Matoba . | |

*Primary Examiner*—Victor N. Sakran

[57] ABSTRACT

A buckle including a male member having a tongue with one or more tongue protrusions each having a tongue engagement portion extending from one or more side portions thereof, and a female member having a recess with one or more recess protrusions each having a recess engagement portion extending from one or more inner side portions thereof. A resilient spring member protruding from one of the tongue or the recess of the female member is engageable with the other of the recess or the tongue to laterally shift the tongue in the recess when the tongue engagement portions are inserted into the recess beyond the recess engagement portions, whereby the tongue engagement portions are engageable with the recess engagement portions to retain the tongue in the recess after the tongue is laterally shifted by the resilient spring member.

18 Claims, 3 Drawing Sheets

NON-FLEX LOCKING BUCKLE

BACKGROUND OF THE INVENTION

The invention relates generally to buckles, and more particularly to mating male and female buckle members for securing extremities of web-like materials.

Mating male and female buckle members are known generally and used widely, for example to secure extremities of web-like materials or straps used in child restraint harnesses, personal flotation devices, waste and back pack belts, head protection gear, and animal collars, among a variety of other applications.

Known prior art buckles include side release buckles of the type disclosed in U.S. Pat. No. 4,150,464 entitled "Buckle", assigned commonly herewith, comprising generally a male member with first and second resilient arms that are flexibly insertable into an accommodating recess of a female member. End portions of the resilient arms are retainably engageable in corresponding openings on opposing sides of the female member upon inserting the resilient arms into the recess thereof. To open, or release, the male and female members, the end portions of the male member are flexed inwardly to disengage from the openings of the female member, whereupon the male member may be withdrawn from the female member.

Known prior art buckles also include center release buckles of the type disclosed in U.S. Pat. No. 4,398,324 entitled "Center Release Buckle", also assigned commonly herewith, comprising generally a male member with a resilient tongue that is insertable into an accommodating recess of a female member. The resilient tongue includes a raised portion that is engageably retainable in an opening on a face of the female member upon inserting the resilient tongue into the recess of the female member. To release the male and female members, the resilient tongue of the male member is flexed inwardly by depressing the tongue to disengage the raised portion thereof from the opening of the female member, whereupon the male member may be withdrawn from the female member.

In these and other known prior art mating male and female buckle members, it is generally necessary to increase the overall size of the buckle to increase the strength of the locking mechanism. Increasing the size of the buckle however is not always desirable, and in many applications increasing the buckle size is not feasible due to weight, appearance, comfort, cost and other practical considerations.

It is generally desirable to provide buckles having a relatively strong locking mechanism and a relatively light or easily actuatable release mechanism, so long as the light release mechanism does not compromise the locking integrity of the buckle by opening inadvertently or accidently. The known prior art buckles however perform the locking and releasing functions with the same structure, for example with the resilient arms in side release buckles and with the resilient tongue in center release buckles. Generally, increasing the strength of the locking mechanism in the prior art buckles correspondingly increases the force required to open or release the buckle, which is undesirable.

The present invention is drawn toward advancements in the art of mating male and female buckle members that overcome problems in the art.

It is an object of the invention to provide novel mating male and female buckle members useable for securing extremities of web-like materials that are economical.

It is another object gf the invention to provide novel mating male and female buckle members with separate locking and releasing mechanisms, whereby the buckles have relatively strong locking characteristics and relatively easily operated releasing characteristics.

It is also an object of the invention to provide novel mating male and female buckle members having releasing mechanisms that do not compromise the strength and locking integrity of the buckle.

It is a further object of the invention to provide novel mating male and female buckle members that have relatively strong locking mechanisms without substantially increasing the overall size of the buckle.

It is still another object of the invention to provide novel mating male and female buckle members having separate locking and releasing mechanisms, whereby the releasing mechanism is located on and actuatable from opposing ends of the male and female buckle members.

It is a more particular object of the invention to provide novel buckles comprising generally a male member having a tongue and one or more tongue protrusions, with corresponding tongue engagement portions, extending from one or more side portions thereof, and a female member having a recess and one or more recess protrusions, with corresponding recess engagement portions, extending from one or more inner side portions thereof. A resilient spring member protruding from one of the tongue or the recess of the female member is engageable with the other of the recess or the tongue to laterally shift the tongue in the recess when the tongue engagement portions are inserted into the recess beyond the recess engagement portions, whereby the tongue engagement portions are engageable with the recess engagement portions to retain the tongue in the recess after the tongue is laterally shifted by the resilient spring member.

It is another more particular object of the invention to provide novel buckles comprising generally a male member having a tongue and one or more tongue protrusions, with corresponding tongue engagement portions, extending from one or more side portions thereof, and a female member having a recess and one or more recess protrusions, with corresponding recess engagement portions, extending from one or more inner side portions thereof. A first tongue end portion is accessible through a recess opening of the female member to laterally shift the tongue in the recess against a resilient spring member, and in some embodiments upon first flexing a locking member out of the recess, to disengage the tongue engagement portions from the recess engagement portions.

These and other objects, aspects, features and advantages of the present invention will become more fully apparent upon careful consideration of the following Detailed Description of the Invention and the accompanying Drawings, which may be disproportionate for ease of understanding, wherein like structure and steps are referenced generally by corresponding numerals and indicators.

DETAILED DESCRIPTION OF THE INVENTION

Figure 1:
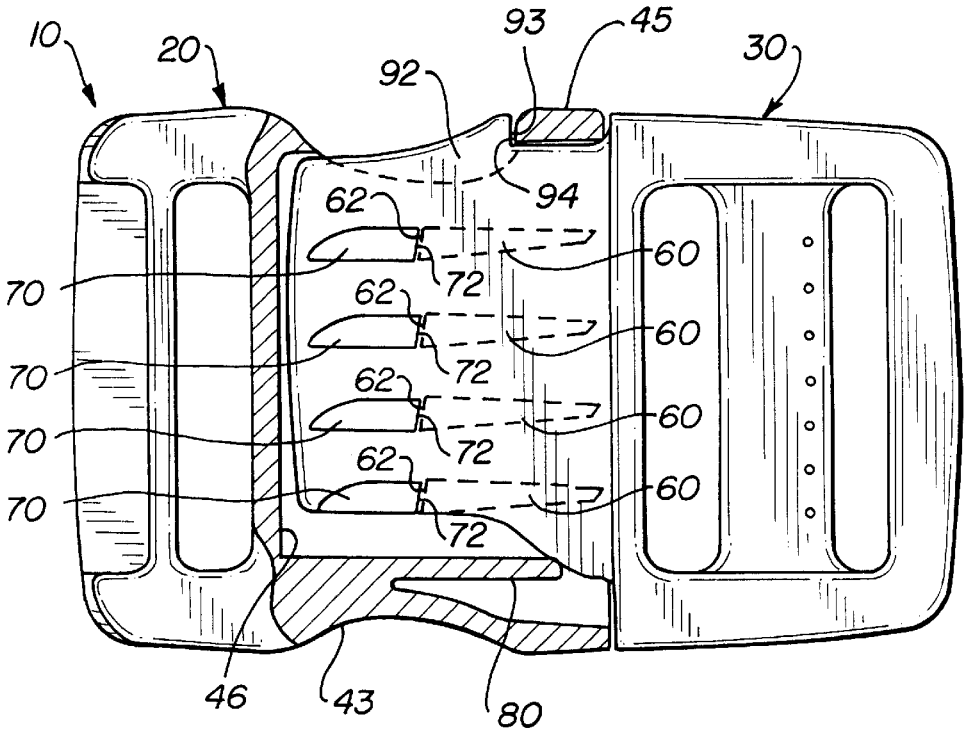
FIG. 1 is a partial sectional view of a buckle having mated male and female members according to an exemplary embodiment of the invention.

FIG. 1 illustrates a buckle 10 useable for securing extremities of web-like materials including straps and ropes and other similar members according to a first exemplary embodiment of the invention. The buckle 10 comprises generally a female member 20 matably engageable with a male member 30, as discussed more fully below. The male and female members 20 and 30 may each include generally one or more corresponding openings for accommodating a looped extremity of the web-like material disposed therethrough, and in some configurations the looped extremity may be frictionally and adjustably engageable thereby, as is known generally.

Figure 2A:
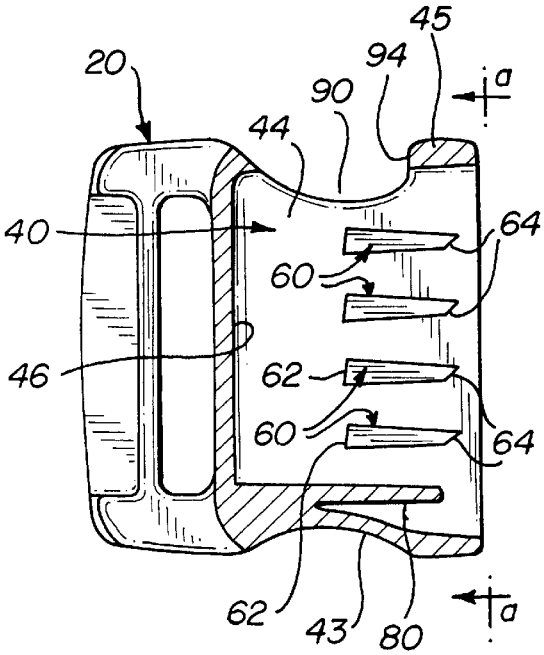
FIG. 2*a* is a partial sectional view of the female member of FIG. 1.
Figure 2B:
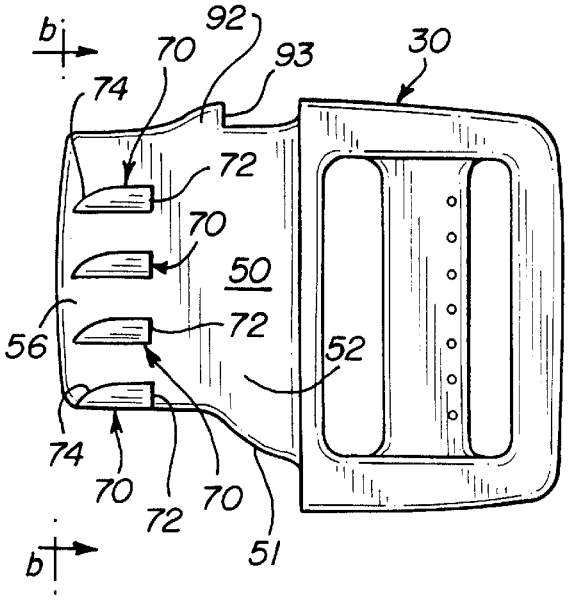
FIG. 2*b* is a side view of the male member of FIG. 1.
Figure 3B:
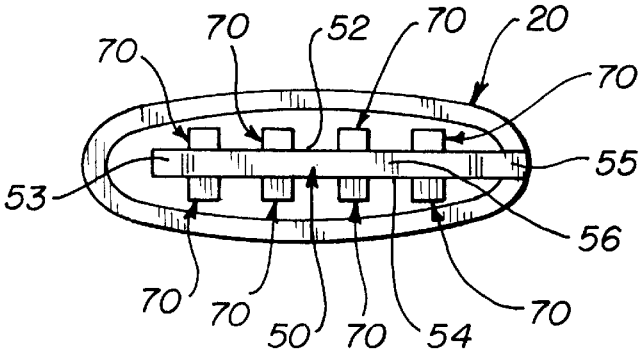
FIG. 3*b* is a view along lines b—b of FIG. 2*b*.
Figure 3A:
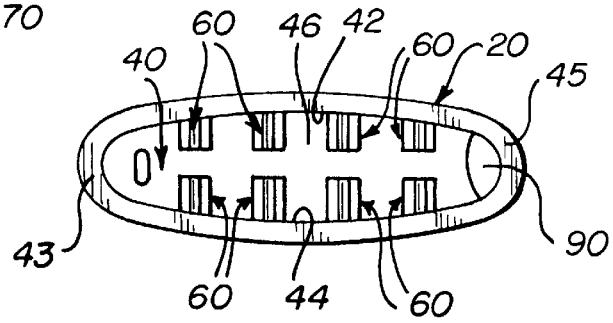
FIG. 3*a* is a view along lines a—a of FIG. 2*a*.

The female member 20 comprises generally a recess 40 with first and second inner side portions 42 and 44, first and second end portions 43 and 45, and an inner recess base portion 46, as illustrated in FIGS. 2*a* and 3*a*. The male member 30 comprises generally a tongue 50 with first and second side portions 52 and 54, first and second end portions 53 and 55, and a leading tip portion 56, as illustrated in FIGS. 2*b* and 3*b*. The tongue 50 is insertable into the recess 40 of the female member 20 with the tip portion 56 of the tongue 30 toward the recess base portion 46 of the female member 20, whereby the female member 20 is releasably engageable with the male member 30 as discussed more fully below.

The female member 20 comprises at least one and preferably a plurality of recess protrusions 60 extending from at least one of the first or second inner side portions 42 and 44 of the recess 40. In the exemplary embodiment of FIG. 3*a*, the plurality of recess protrusions 60 extend from both the first and second inner side portions 42 and 44 of the recess 40. The tongue 50 also comprises at least one and preferably a plurality of tongue protrusions 70 extending from at least one of the first or second side portions thereof. In the exemplary embodiment of FIG. 3*b*, the plurality of tongue protrusions 70 extend from the first and second side portions 52 and 54 thereof. The one or more recess protrusions 60 of the female member 20 cooperate generally with a corresponding one of the tongue protrusions 70 of the male member 30 to releasably engage the male and female members 20 and 30 when the tongue 50 is disposed, or inserted, into the recess 40, as discussed further below.

The one or more recess protrusions 60 of the female member 20 and the one or more tongue protrusions 70 of the male member 30 are arranged generally to permit insertion of the tongue 50 into the recess 40. In the exemplary embodiment of FIGS. 3*a* and 3*b*, the tongue 50 is insertable between the plurality of recess protrusions 60 extending from both the first and second inner side portions 42 and 44 of the recess 40. In embodiments having one or more recess protrusions extending from only one of the first or second inner side portions 42 and 44 of the recess 40, the tongue 50 is insertable between the recess protrusions on the one inner side portion of the recess and the other inner side portion of the recess without any recess protrusions.

The tongue 50 and the recess 40 are dimensioned generally so that the tongue 50 is retained in the recess 40 without substantial movement toward and away from the substantially opposing first and second inner side portions 42 and 44 thereof. The tongue 50 and the recess 40 are dimensioned, however, to permit lateral movement of the tongue 50 in the recess 40 toward and away from the substantially opposing end portions 43 and 45 of the female member 20, as discussed further below.

The one or more recess protrusions 60 of the female member 20 each have a corresponding recess engagement portion directed generally toward the recess base portion 46. FIG. 2*a* illustrates the recess protrusions 60 on the second inner side portion 44 each having a corresponding recess engagement portion 62 directed generally toward the recess base portion 46. In embodiments having recess protrusions 60 on the first inner side portion 42 of the recess 40, the recess protrusions 60 also have a corresponding recess engagement portion, not illustrated in FIG. 2*a*, directed generally toward the recess base portion 46.

The one or more tongue protrusions 70 of the male member 30 each also have a corresponding tongue engagement portion directed generally away from the leading tip portion of the tongue. FIG. 2*b* illustrates the tongue protrusions 70 on the first side portion 52 each having a corresponding tongue engagement portion 72 directed generally away from the leading tip portion 56 of the tongue 50. In embodiments having tongue protrusions 70 on the second side portion 54 of the tongue 50, the tongue protrusions 70 also have a corresponding tongue engagement portion, not illustrated in FIG. 2*b*, directed generally away from the leading tip portion 56 of the tongue 50.

The recess protrusions 60 of the female member 20 and the tongue protrusions 70 of the male member 30 are arranged generally so that the recess engagement portions 62 are engageable with a corresponding one of the tongue engagement portions 72 when the tongue 50 is inserted into the recess 40 of the female member 20 to securely couple the female and male members 20 and 30. The one or more recess protrusions 60 of the female member 20 and the one or more tongue protrusions 70 of the male member 30 are also arranged generally to permit the one or more tongue engagement portions to pass beyond the one or more recess engagement portions as the tongue 50 is disposed into the recess 40 of the female member 20, before the recess protrusions 60 are engageable with the tongue protrusions 70.

More particularly, the plurality of recess protrusions 60 are arranged generally spaced apart in series across one or both of the first and second inner side portions 42 and 44 of the recess 40 between the first and second end portions 43 and 45 of the female member 20. Similarly, the plurality of tongue protrusions 70 are arranged generally spaced apart in a series across one or both of the first and second side portions 52 and 54 of the tongue 50 between the first and second end portions 53 and 55 thereof. In the exemplary embodiment, the plurality of recess protrusions 60 are arranged across both the first and second inner side portions 42 and 44 of the female member 20, and the tongue protrusions 70 are arranged across both the first and second side portions 52 and 54 of the male member 30.

The plurality of recess protrusions 60 and the plurality of tongue protrusions 70 are both arranged and spaced generally to permit passage of the plurality of tongue engagement portions 72 along side and beyond the plurality of recess engagement portions 62 as the tongue 50 is inserted into the recess 40. Preferably, each of the plurality of tongue engagement portions 72 are passable along side and beyond a corresponding one of the plurality of recess engagement portions 62 as the tongue 50 is disposed into the recess 40 of the female member 20. In the exemplary embodiment, the tongue and recess protrusions 60 and 70 are generally elongate rib shaped members with corresponding leading end portions 64 and 74, respectively, and a trailing end portion having a corresponding engagement portion 62 and 72, respectively. The tongue and recess protrusions 60 and 70 however may have other shapes and configurations, and the corresponding engagement portion thereof is not necessarily on the trailing end portion thereof, but may instead be located for example along a side portion thereof.

In the exemplary embodiment of FIGS. 2*a* and 2*b*, each of the tongue protrusions 70 is insertable along side a corresponding recess protrusion 60 as the tongue 50 is inserted into the recess 40 of the female member 20, at least until each tongue protrusion portion 72 is inserted beyond the corresponding recess protrusion portion 62. More particularly, the tongue protrusions 70 on the second side portion 54 of the tongue 50, illustrated in FIG. 3*b* but not in FIG. 2*b*, are insertable along side corresponding recess protrusions 60 on the second inner side 44 of the recess 40 illustrated in FIG. 2*a*. Similarly, the tongue protrusions 70 in the first side portion 52 thereof illustrated in FIG. 2*b* are insertable along side corresponding recess protrusions 60 on the first inner side 42 of the recess 40 illustrated in FIG. 3*a* but not in FIG. 2*a*, since FIG. 2*a* is a sectional view illustrating only the second inner side portion 44 of the female member 20.

FIG. 2*a* illustrates the recess protrusions 60 preferably having corresponding angled leading end portions 64, and FIG. 2*b* illustrates the tongue protrusions 70 preferably having corresponding complementarily angled leading end portions 74. The angled leading end portions 64 and 74 are engageable to laterally deflect the tongue 50 toward the end portion 43 of the female member 20 as the tongue 50 is inserted initially into the recess 40 thereof so that each of the tongue protrusions 70 is aligned and insertable along side a corresponding one of the recess protrusions 60. The leading end portions 64 of the recess protrusions 60 on the second inner side portion 44 of FIG. 2*a* are engageable with corresponding leading end portions 74 of the tongue protrusions 70 on the second side portion 54 of the tongue 50 illustrated in FIG. 3*b*, opposing the first side portion 52 of the tongue in FIG. 2*b*.

According to the present invention, generally, a resilient spring member protrudes from one of the tongue 50 or the recess 40 of the female member 20. The resilient spring member is engageable with the other of the recess 40 or the tongue 50 to laterally shift the tongue 50 in the recess 40 after the tongue engagement portion is inserted into the recess beyond the recess engagement portion. FIG. 1 illustrates the one or more tongue engagement portions 72 engageable with a corresponding one of the recess engagement portions 62 to retain the tongue 50 in the recess 40 after the tongue 50 is laterally shifted in the recess 40 by the resilient spring member 80.

FIGS. 1 and 2*a* illustrate a resilient spring member 80 protruding into the recess 40 of the female member 20 from the first end portion 43 of the female member 20, whereby the spring member 80 is engageable with a portion of the tongue 50 as the tongue is inserted into the recess 40, and more particularly with a camming portion 51 on the first side portion 53 thereof. In the embodiment illustrated in FIGS. 4 and 5, the resilient spring member 80 protrudes into the recess 40 of the female member 20 from the recess base portion 46 thereof, whereby the spring member 80 is engageable with a camming portion 57 formed along a tongue recess 59 in an intermediate portion of the tongue 50. More generally and equivalently, the resilient spring member may protrude from either end portion, or an intermediate portion, of the tongue and be engageable with a camming surface formed on a corresponding inner end portion, or intermediate portion, of the recess of the female member.

In operation, referring to FIGS. 1–3, as the tongue 50 is inserted into the recess 40 so that the tongue protrusions 70 move along side a corresponding one of the recess protrusions 60, as discussed above, the resilient spring member 80 engages the camming portion 51 to increasingly flex the resilient spring member 80 as the tongue 50 is increasingly disposed into the recess 40. After the one or more tongue engagement portions 72 are inserted into the recess 40 beyond the corresponding recess engagement portions 62, the flexed resilient spring member 80 laterally shifts the tongue 50 in the recess 40 toward the second end portion 45 of the female member 20, whereby the tongue engagement portions 72 are engageable with the recess engagement portions 72 to retain the tongue 50 in the recess 40 of the female member 20, as illustrated in FIG. 1. The embodiment of FIGS. 4 and 5 operate similarly, the difference being that the resilient spring member 80 protruding from the intermediate portion of the recess base portion 46 engages the camming surface 57 on the intermediate portion of the tongue 50.

The resilient spring member 80 is generally configured to maintain the tongue 50 shifted laterally in the recess 40 so that the tongue protrusions 72 are engageable with the recess protrusion 62, at least upon applying a withdrawing force to the tongue 50, thereby securely retaining the male member 20 in the female member 30. In some embodiments, illustrated in FIG. 4, the resilient spring member 80 may be configured to maintain a bias on the tongue 50 when the tongue 50 is laterally shifted in the recess 40 of the female member 20, and more particularly the resilient spring member 80 remains flexed when the tongue 50 is inserted and shifted laterally in the recess 40 of the female member. In other embodiments, however, it is not necessary for the resilient spring member 80 to maintain a bias on the tongue 50, particularly in applications including a locking member as discussed further below.

The tongue 50 is retained in the recess 40 of the female member 20 by the engagement of the recess and tongue engagement portions 62 and 72, which prevent separation of the male and female members 20 and 30. The retention strength of the buckle 10 may be increased by increasing the number of cooperating recess and tongue engagement portions, and more generally the engageable surface therebetween normal, or perpendicular, to forces tending to separate the male and female buckle members, without significantly increasing the overall size of the buckle. A remarkable aspect of the invention is that the retention strength of the buckle 10 is relatively independent of buckle size. A relatively small buckle may therefore have a relatively high retention strength, which is highly desirable for many applications. Thus it is now possible to use a relatively small size buckle where in the past a relatively large prior art buckle was required, wherein the smaller buckles of the present invention have the same or better retention strength as larger prior art buckles.

Figure 4:
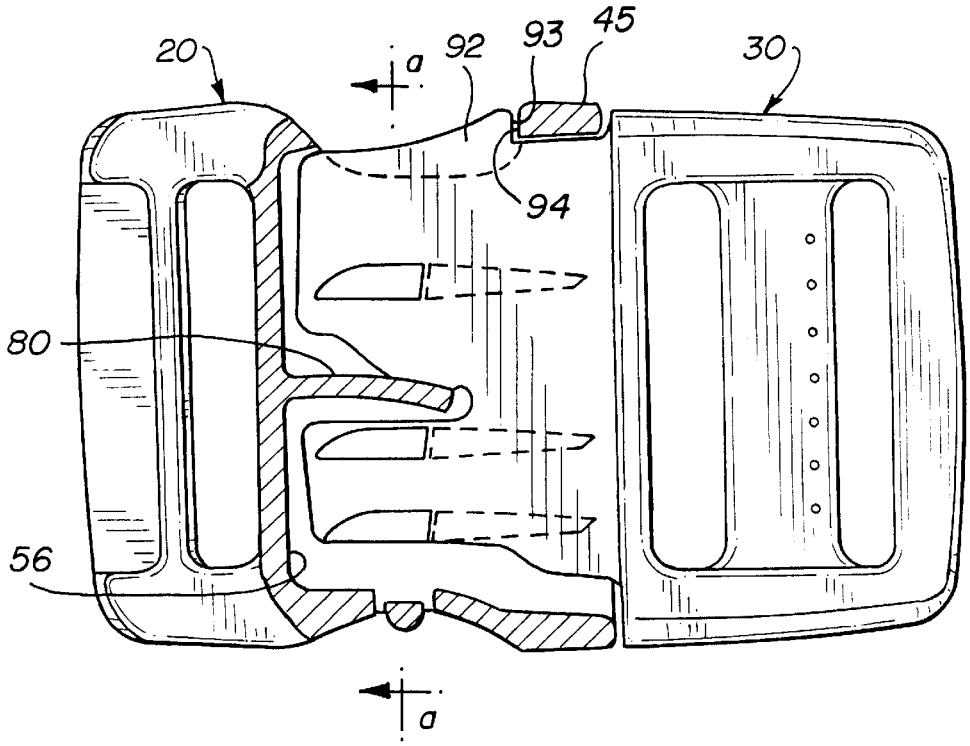
FIG. 4 is a partial sectional view of another buckle having mated male and female members according to an alternative embodiment of the invention.
Figure 5A:
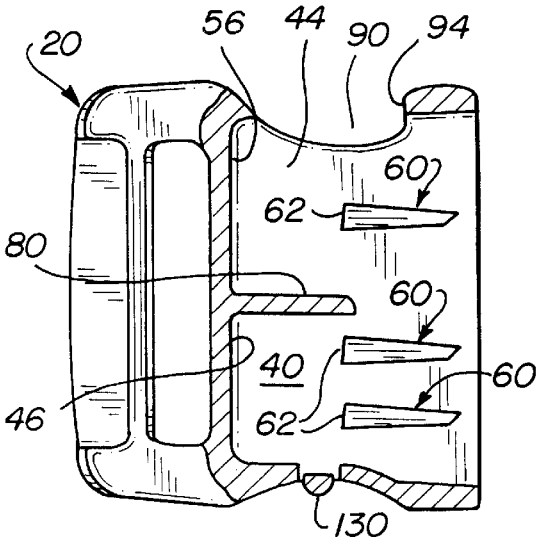
FIG. 5*a* is a partial sectional view of the female member of FIG. 4.
Figure 5B:
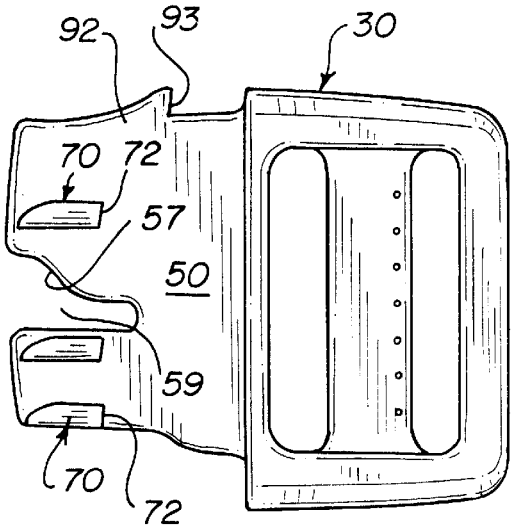
FIG. 5*b* is a side view of the male member of FIG. 4.

FIGS. 2*a*, 3*a* and 5*a* illustrate the female member 20 including a recess opening 90 on an end portion thereof, which is the second end portion 45 in the exemplary embodiment, and FIGS. 2*b* and 5*b* illustrate the tongue 50 having a tongue end portion 92. FIGS. 1 and 4 illustrate the tongue end portion 92 protruding from the recess opening 90 of the female member 20 when the tongue 50 is shifted laterally in the recess 40 thereof by the resilient spring member 80, as discussed above. The tongue end portion 92 also preferably includes a tongue engagement portion 93 engageable with a recess engagement portion 94 on the recess opening 90 when the tongue 50 is shifted laterally in the recess 40 by the resilient spring member 80, to further increase buckle retention strength.

The tongue end portion 92 is accessible through the recess opening 90 to laterally shift the tongue 50 in the recess 40 against the resilient spring member 80, which may be flexed to apply a bias to the tongue 50 as discussed above, to disengage the one or more tongue engagement portions 72 from the corresponding recess engagement portions 62, and more particularly to laterally offset the recess and tongue engagement portions so that the tongue 50 may be withdrawn from the recess 40 of the female member 20. According to a related aspect of the invention, the recess and tongue engagement portions 62 and 72 are preferably formed at complementary angles configured so that the tongue member 50 is inserted more fully into the recess 40 as the tongue 50 is shifted laterally against the resilient spring member 80, thereby reducing the likelihood of inadvertent or unintentional buckle release.

The tongue 50 is released from the recess 40 of the female member 20 by laterally shifting the tongue 50 against the resilient spring member 80, which may be flexed to bias the tongue 50, as discussed. The force required to laterally shift the tongue 50 against the resilient spring member 80, and thus to release the female and male members 20 and 30 is relatively light and is unrelated to, or independent, of buckle retention strength. Thus increasing the buckle retention strength, as discussed above, has no affect on the force required to release the male and female members, or to open the buckle, which is a significant and highly desirable improvement over the prior art. Additionally, increasing the size of the buckle does not increase the force required to open the buckle, since the release force is determined primarily by the spring constant, or stiffness, of the resilient spring member 80.

Figure 6:
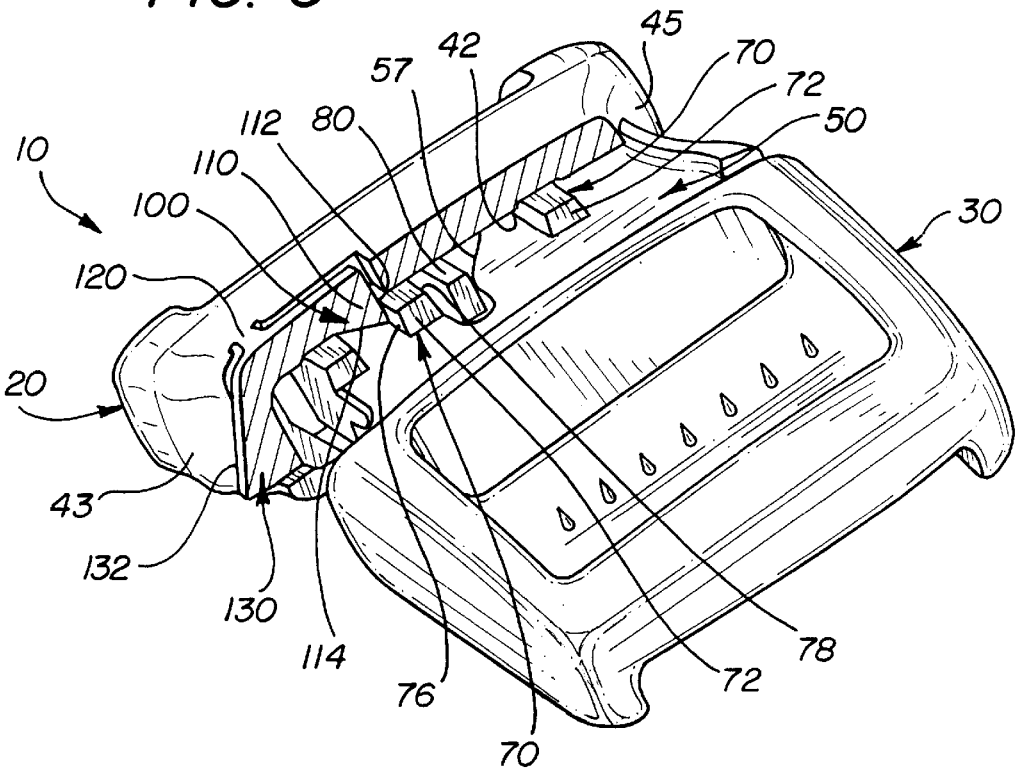
FIG. 6 is a partial sectional view along lines a—a of FIG. 4.

The buckle 10 in the embodiment of FIG. 6 further comprises a locking member 100, shown sectionally, protruding into the recess 40 of the female member 20 from one of the first and second side portions thereof, and in the exemplary embodiment from the first inner side portion 42 thereof. The locking member 100 is generally engageable with one of the tongue protrusions 70 when the tongue is inserted and shifted laterally in the recess 40 by the resilient spring member 80 so that the one or more tongue engagement portions are positioned to engage, or are engageable with, a corresponding recess engagement portion, not illustrated in FIG. 6, whereby the locking member 100 prevents lateral shifting of the tongue 50 in the recess 40 against the resilient spring member 80.

The locking member 100 includes more particularly a protrusion 110 with a locking engagement portion 112 protruding into the recess 40 and engageable with a side portion 76 of one of the tongue protrusions 70 when the tongue 50 is inserted and shifted laterally in the recess 40 by the resilient spring member 80 to prevent lateral shifting of the tongue 50 against the resilient spring member 80. In FIG. 6, the resilient spring member 80 is engageable with the camming portion 57 to laterally position the tongue 50 toward the second end portion 45 of the female member 20, and the locking engagement portion 112 is engageable with a side portion 76 of the tongue protrusion 70 generally opposite the second end portion 45 of the female member 20, thereby preventing lateral shifting of the tongue 50 away from the second end portion 45 of the female member 20.

The locking member 100 is preferably a resilient locking spring member biased to protrude into the recess 40, and is flexible against the bias to withdraw the protrusion 110 and locking engagement portion 112 thereof out of the recess 40 to permit insertion of the tongue 50 therein. FIG. 6 illustrates the locking member 100 coupled to the female member 20 by a resilient pivot 120 protruding from a side portion thereof, and preferably from opposing side portions thereof, the other side not being illustrated in the sectional view. The locking member 100 is generally flexible about the resilient pivot 120 to withdraw the locking member 100 from the recess 40, whereby the resilient pivot 120 biases the locking member 100 so that it protrudes into the recess 40.

FIG. 6 illustrates the locking member 100 having a sloped or bevelled portion 114 engageable by the tongue protrusion 70 to flex the locking member 100 out of the recess 40 as the tongue 50 is inserted initially therein. In operation, as the tongue protrusion 70 passes along side a corresponding recess protrusion 60 during insertion of the tongue 50 into the recess 40, the tongue protrusion 70 passes under the bevelled portion 114, flexing the locking member 100 out of the recess 40 to permit passage of the tongue protrusion 70. In FIG. 6, more particularly, a corner 78 of the tongue protrusion 70 engages the bevelled portion 114 of the locking member 100 to flex the locking member 100 out of the recess 40. After the one or more tongue engagement portions are inserted into the recess beyond the corresponding recess engagement portions, the resilient spring member 80 laterally shifts the tongue 50 toward the second end portion 45 of the female member 20, whereupon the locking member 100 flexes back into the recess 40 where it is engageable with the tongue protrusion 70 to prevent lateral shifting thereof in the recess 40 against the resilient spring member 80, as discussed above.

The locking member 100 is also flexible to withdraw the protrusion 110 and locking engagement portion 112 thereof out of the recess 40 to permit lateral shifting of the tongue 50 against the resilient spring member 80 to release the male and female members 20 and 30, as discussed generally above. For this purpose, a locking member actuator 130 is coupled generally to the locking member 100 and operates as a lever to flex the locking member 100 about the resilient pivot 120 and out of the recess 40.

In the exemplary embodiment, the locking member actuator 130 is an actuator arm coupled to the locking member 100, and extending from another side of the resilient pivot 120. The actuator arm 130 includes an engagement portion 132 protruding from the female member 20, at least when the locking member 100 protrudes into the recess 40. By applying a force that moves the actuator arm inwardly toward the recess 40, the locking member 100 is flexible about the resilient pivot 120 and out of the recess 40 to disengage the tongue protrusion 70, whereupon the tongue 50 is laterally shiftable in the recess 40 against the resilient spring member 80 to permit withdrawal of the tongue 50 from the recess 40 of the female member 20.

FIGS. 5*a* and 6 illustrate the actuator 130 extending preferably along an end portion of the female member 20 opposite the recess opening 90 thereof, which is the first end portion 43 in the exemplary embodiment, whereby the tongue 50 may be released from the recess 40 of the female member 20 upon depressing the engagement portion 132 on the one end portion of the female member 20, to withdraw the locking member 100 from the recess, and depressing the tongue end portion 92 accessible through the recess opening 90 on the other opposing end portion 45 of the female member 20 to laterally shift the tongue 50 against the resilient spring member 80, which is flexed to bias the tongue 50 toward the end portion 45 of the female member 20 in FIG. 4.

The male and female members 20 and 30, in the various embodiments discussed above, are each formed preferably as unitary members made from a plastic material, for example acetal or nylon or some other moldable material, which may include additives for strength, in a molding operation. In alternative embodiments, the male member 30 and especially the female member 20 may be formed as an assembly of multiple components, which are snap-fit or screwed or otherwise fastened together.

While the foregoing written description of the invention enables one of ordinary skill to make and use what is considered presently to be the best mode thereof, those of ordinary skill will understand and appreciate the existence of variations, combinations, and equivalents of the specific exemplary embodiments herein. The invention is therefore to be limited not by the exemplary embodiments herein, but by all embodiments within the scope and spirit of the appended claims.

What is claimed is:

1. A buckle comprising:

a male member having a tongue, at least one tongue protrusion extending from a side portion of the tongue, the at least one tongue protrusion having a tongue engagement portion;

a female member having a recess, at least one recess protrusion extending from an inner side portion of the recess, the at least one recess protrusion having a recess engagement portion, the tongue engagement portion is passable beyond the recess engagement portion as the tongue is disposed into the recess of the female member;

a resilient spring member protruding from one of the tongue or the recess of the female member, the resilient spring member engageable with the other of the recess or the tongue to laterally shift the tongue in the recess when the tongue engagement portion is inserted into the recess beyond the recess engagement portion, whereby the tongue engagement portion is engageable with the recess engagement portion to retain the tongue in the recess after the tongue is laterally shifted by the resilient spring member.

2. The buckle of claim 1, the tongue having a leading tip portion, the tongue engagement portion of the at least one tongue protrusion directed generally away from the leading tip portion of the tongue, and the recess of the female member having a recess base portion, the recess engagement portion of the at least one recess protrusion directed generally toward the recess base portion, the tongue is shiftable laterally in the recess by the resilient spring member to at least partially align the tongue protrusion and the recess protrusion.

3. The buckle of claim 1, the tongue of the male member having a first side portion and a second side portion, a plurality of tongue protrusions extending from at least one of the first or second side portions of the tongue, the plurality of tongue protrusions having a corresponding tongue engagement portion;

the recess of the female member having a first inner side portion and a second inner side portion, a plurality of recess protrusions extending from at least one of the first or second inner side portions of the recess, the plurality of recess protrusions having a corresponding recess engagement portion, the plurality of tongue engagement portions are passable beyond the plurality of recess engagement portions as the tongue is disposed into the recess of the female member;

the tongue is laterally shiftable in the recess by the resilient spring member when the tongue engagement portions are inserted into the recess beyond the recess engagement portions, whereby at least some of the tongue engagement portions are engageable with corresponding recess engagement portions to retain the tongue in the recess after the tongue is laterally shifted by the resilient spring member.

4. The buckle of claim 3, the plurality of tongue protrusions are arranged spaced apart in a series between opposing first and second end portions of the male member, and the plurality of recess protrusions are arranged spaced apart in a series between opposing first and second end portions of the female member, whereby the plurality of tongue engagement portions are passable along side and beyond a corresponding one of the plurality of recess engagement portions as the tongue is disposed into the recess of the female member.

5. The buckle of claim 3, the plurality of tongue protrusions extending from the first and second side portions of the tongue, and the plurality of recess protrusions extending from the first and second inner side portions of the recess.

6. The buckle of claim 1, the female member having a recess opening on an end portion of the female member, the tongue having a tongue end portion protruding from the recess opening of the female member when the tongue is shifted laterally in the recess by the resilient spring member, the tongue end portion is accessible to laterally shift the tongue in the recess against the resilient spring member to disengage the tongue engagement portion from the recess engagement portion.

7. The buckle of claim 1, the resilient spring member protrudes from the recess of the female member and is engageable with a portion of the tongue.

8. The buckle of claim 7 further comprising a camming portion on the tongue, the resilient spring member engageable with the camming portion to increasingly flex the resilient spring member as the tongue is increasingly disposed into the recess, whereby the resilient spring member laterally shifts the tongue in the recess after the tongue engagement portion is inserted into the recess beyond the recess engagement portion.

9. The buckle of claim 8 further comprising the resilient spring member protruding in the recess of the female member from a recess base portion of the recess, the camming portion is formed along a tongue recess in an intermediate portion of the tongue.

10. The buckle of claim 1 further comprising a locking member protruding into the recess from an inner side portion thereof, the locking member is engageable with the tongue protrusion when the tongue engagement portion is engageable with the recess engagement portion, whereby the locking member prevents lateral shifting of the tongue in the recess against the resilient spring member.

11. The buckle of claim 10, the locking member is a resilient locking spring member biased to protrude into the recess, the resilient locking spring member is flexible out of the recess as the tongue is inserted into the recess to permit the tongue engagement portion to pass beyond the recess engagement portion.

12. The buckle of claim 10 further comprising a resilient pivot coupling the locking member to the female member, and a locking member actuator coupled to the locking member for flexing the locking member about the pivot and out of the recess to permit lateral shifting of the tongue in the recess against the resilient spring member.

13. The buckle of claim 12, the female member having a recess opening on an end portion of the female member, the tongue having a tongue end portion protruding from the recess opening of the female member when the tongue is shifted laterally in the recess by the resilient spring member, the tongue end portion is accessible to laterally shift the tongue in the recess against the resilient spring member when the locking member is flexed out of the recess to disengage the tongue engagement portion from the recess engagement portion.

14. The buckle of claim 13, the locking member actuator is located on an end portion of the female member generally opposite the end where the recess opening is located.

15. The buckle of claim 12, the male and female members are unitary members.

16. The buckle of claim 1, the male and female members are unitary members.

17. The buckle of claim 1, the male and female members are formed of plastic materials.

18. The buckle of claim 1, the resilient spring member is flexed to apply a bias to the tongue in the recess after the tongue is laterally shifted by the resilient spring member so that the tongue engagement portion is engageable with the recess engagement portion.

* * * * *